US007762841B2

(12) United States Patent
Ho

(10) Patent No.: US 7,762,841 B2
(45) Date of Patent: Jul. 27, 2010

(54) COAXIAL CABLE CONNECTOR

(75) Inventor: Hsin-Tsung Ho, Taipei Hsien (TW)

(73) Assignee: Cheng Uei Precision Industry Co., Ltd, Taipei Hsien (TW)

( * ) Notice: Subject to any disclaimer, the term of this patent is extended or adjusted under 35 U.S.C. 154(b) by 6 days.

(21) Appl. No.: 12/209,514

(22) Filed: Sep. 12, 2008

(65) Prior Publication Data

US 2010/0068927 A1 Mar. 18, 2010

(51) Int. Cl.
*H01R 17/18* (2006.01)

(52) U.S. Cl. ..... 439/582

(58) Field of Classification Search ..... 439/582, 439/581, 584, 585, 578
See application file for complete search history.

(56) References Cited

U.S. PATENT DOCUMENTS 5,263,877 A 11/1993 Mitani
6,305,980 B2 * 10/2001 Ko ..... 439/582
6,712,645 B1 * 3/2004 Chou ..... 439/582
7,025,598 B2 * 4/2006 Ikeda ..... 439/63
7,367,840 B2 * 5/2008 Chen et al. ..... 439/581

* cited by examiner

*Primary Examiner*—Alexander Gilman
(74) *Attorney, Agent, or Firm*—WPAT, P.C.; Anthony King

(57) ABSTRACT

A coaxial cable connector includes a housing, a terminal received in the housing, a cover located in the housing and pressed on the terminal and a shell enclosing the housing. The housing has a holding portion defining a bottom board and a tubular portion extending downward from the bottom board. The holding portion has an erect portion which defines a locating cavity thereon and two supporting portions which form a receiving recess therebetween receptively protruding upward at a rear portion and a front portion of the bottom board and a passageway between the erect portion and the supporting portions and penetrating through the bottom board and the tubular portion. The terminal has a base portion located in both the locating cavity and the receiving recess and a mating portion received in the passageway. The base portion defines a plurality of protruding thorns on two opposite sides thereof rubbing against opposite inner surfaces of the locating cavity and the receiving recess for fixing the terminal in the housing.

7 Claims, 4 Drawing Sheets

COAXIAL CABLE CONNECTOR

BACKGROUND OF THE INVENTION

1. Field of the Invention

The present invention relates to a connector, and more particularly to a coaxial cable connector.

2. The Related Art

A coaxial cable connector is, for example, disclosed in U.S. Pat. No. 5,263,877. The coaxial cable connector includes a dielectric member holding a central terminal within an outer conductive shell. The central terminal has a U-shaped connection portion for connecting with a coaxial cable, and a coupling portion for mating with a complementary plug. As disclosed in this patent, in assembly, an upper side wall of the dielectric member and a holder portion of the outer conductive shell are bent substantially at a right-angle to hold the connection portion of the central terminal and an inner conductor of the coaxial cable within the dielectric member.

However, the central terminal can not be held within the dielectric member firmly, and a movement of the central terminal would likely occur when the coaxial cable connector mates with the complementary plug, which makes the coupling portion of the central terminal can not stably mate with the complementary plug. As a result, signals cannot be transmitted reliably between the coaxial cable connector and the complementary plug.

SUMMARY OF THE INVENTION

An object of the present invention is to provide a coaxial cable connector adapted for mating with a complementary connector stably. The coaxial cable connector includes a housing, a terminal received in the housing, a cover received in the housing and pressed on the terminal, and a shell enclosing the housing. The housing has a holding portion defining a bottom board and a tubular portion extending downward from the bottom board. The holding portion has an erect portion which defines a locating cavity thereon and two supporting portions which form a receiving recess therebetween protruding upward at a rear portion and a front portion of the bottom board respectively, and a passageway between the erect portion and the supporting portions and penetrating through the bottom board and the tubular portion. The terminal has a base portion located in both the locating cavity and the receiving recess and a mating portion received in the passageway. The base portion defines a plurality of protruding thorns on opposite sides thereof rubbing against opposite inner surfaces of the locating cavity and the receiving recess.

As described above, the protruding thorns project from the opposite sides of the base portion of the terminal for rubbing against the opposite inner surfaces of the locating cavity and the receiving recess, which makes the terminal to be held in the housing securely, so that the movement of the terminal can be avoided and signals can be transmitted reliably between the coaxial cable connector and the complementary connector.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
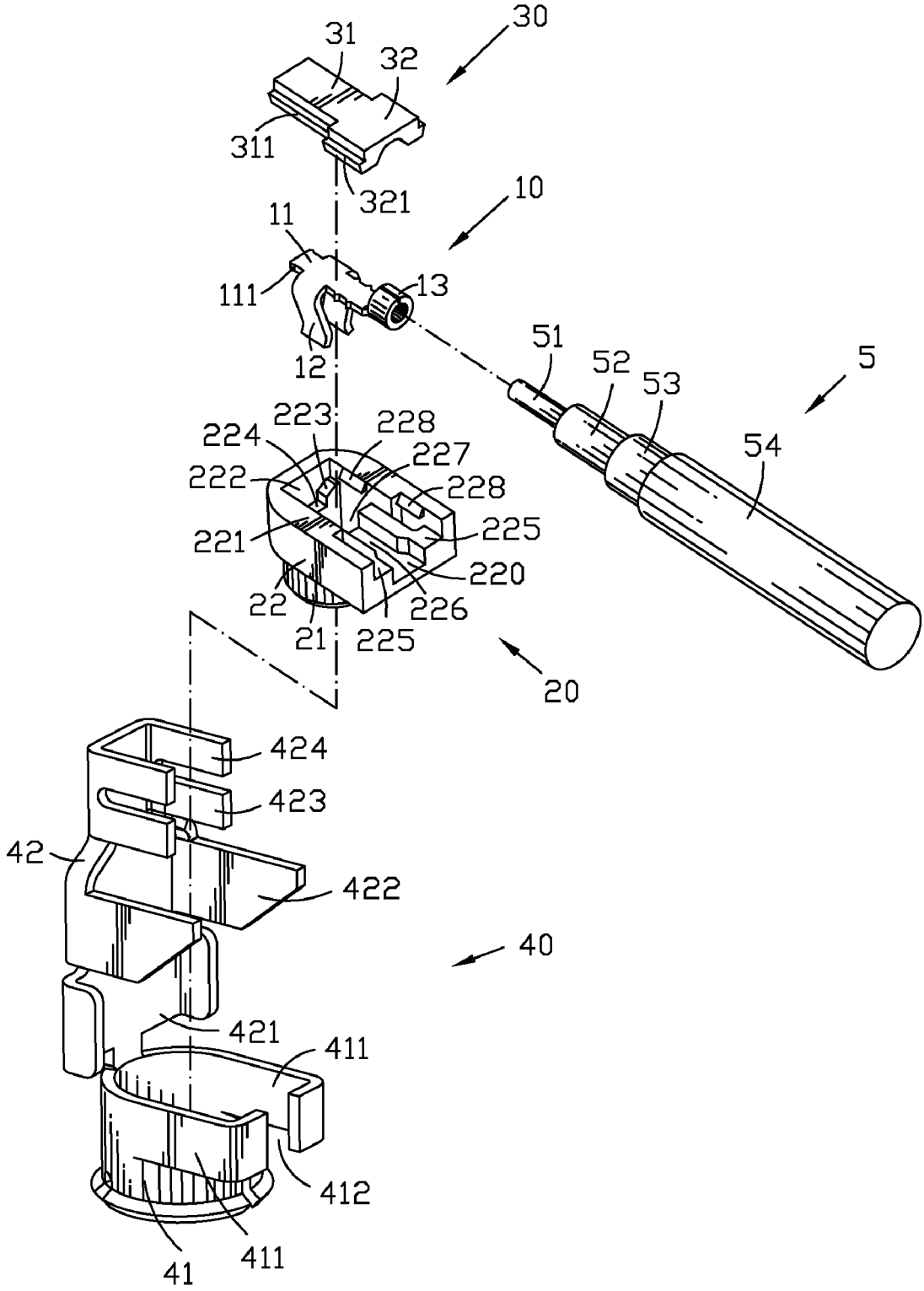
FIG. 1 is an exploded view of a coaxial cable connector mating with a coaxial cable in accordance with the present invention.

With reference to FIG. 1, a coaxial cable connector for mating with a coaxial cable 5 includes a terminal 10, a housing 20 for holding the terminal 10, a shell 40 for surrounding the housing 20 and a cover 30 mounted between the housing 20 and the shell 40 to press the terminal 10 in the housing 20. The coaxial cable 5 has an inner conductor 51, a braiding layer 53, an inner insulator 52 separating the inner conductor 51 from the braiding layer 53, and an outer insulator 54 surrounding the braiding layer 53.

The housing 20 has a tubular portion 21 and an holding portion 22 disposed at the top of the tubular portion 21. The holding portion 22 has a bottom board 220, two sidewalls 221 extending upward from two opposite sides of the bottom board 220 and a rear wall 222 of which two side ends respectively connect with the two sidewalls 221 extending upward from a rear end of the bottom board 220. The bottom board 220, the two sidewalls 221 and the rear wall 222 corporately define a receiving space therebetween. A rear portion of the bottom board 220 protrudes upward to form an erect portion 223 in front of the rear wall 222. The erect portion 223 defines a locating cavity 224 at a middle portion thereof. Two supporting portions 225 attached to inner sides of the two sidewalls 221 protrude upward on the opposite sides of the bottom board 220 in the receiving space. The space between the two supporting portions 225 is defined as a receiving recess 226. A substantially rectangular passageway 227 is defined between the erect portion 223 and the two supporting portions 225 and axially penetrates through the bottom board 220 and the tubular portion 21, wherein the locating cavity 224 and the receiving recess 226 communicate with the passageway 227. Two wedge lumps 228 protrude toward the receiving space from a top portion of each sidewall 221 thereof.

The shell 40 has a trunk portion 41 and a fastener portion 42 extending upward on a rear portion of the trunk portion 41. The trunk portion 41 has a pair of substantially rectangular arms 411 extending forward on opposite sides of an upper portion thereof. Free ends of the arms 411 are inwardly bent and a gap 412 is formed therebetween. The fastener portion 42 has a cover portion 421 for covering the trunk portion 41. Two opposite edges of the cover portion 421 respectively extend forward to form a pair of first engagement tongue portions 422, a pair of second engagement tongue portions 423 and a pair of third engagement tongue portions 424.

Figure 2:
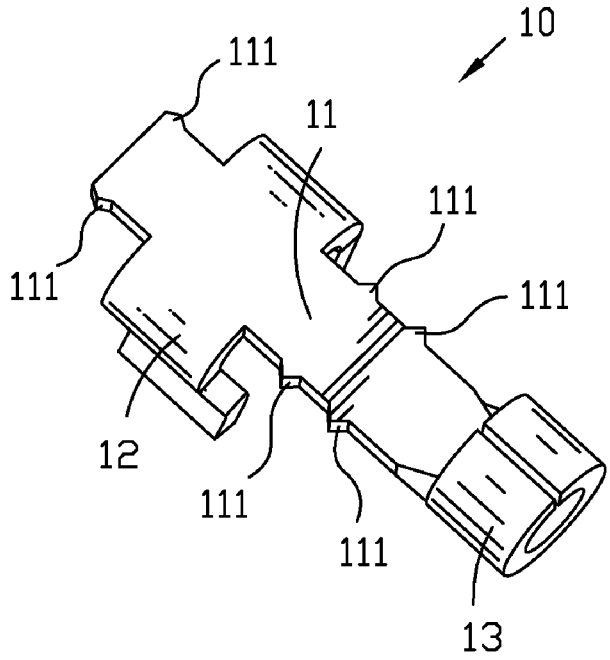
FIG. 2 is a perspective view of a terminal of the coaxial cable connector.

Please refer to FIG. 1 and FIG. 2. The terminal 10 has a substantially rectangular base portion 11 and a pair of mating portions 12 extending downward from two opposite sides of the base portion 11. Free ends of the mating portions 12 project toward each other for mating with a complementary connector 6 (shown in FIG. 6). Opposite sides of one tip end of the base portion 11 respectively extend outward to form a substantially rectangular retaining portion 13 capable of being curled up to retain the inner conductor 51 of the coaxial cable 5 when the coaxial cable 5 contacts with the terminal 10.

Two protruding thorns 111 extend outward at opposite sides of the other tip end of the base portion 11 and several protruding thorns 111 extend outward at the opposite sides of the base portion 11 between the mating portion 12 and the retaining portion 13. All of the protruding thorns 111 are sawtooth-shaped.

Figure 3:
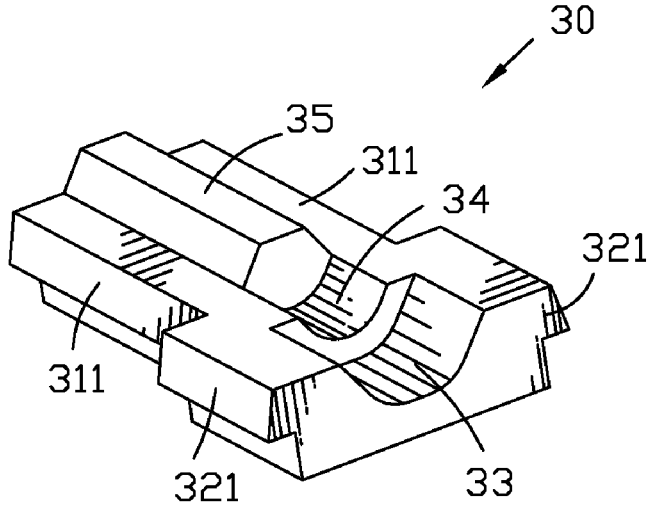
FIG. 3 is a perspective view of a cover of the coaxial cable connector.
Figure 4:
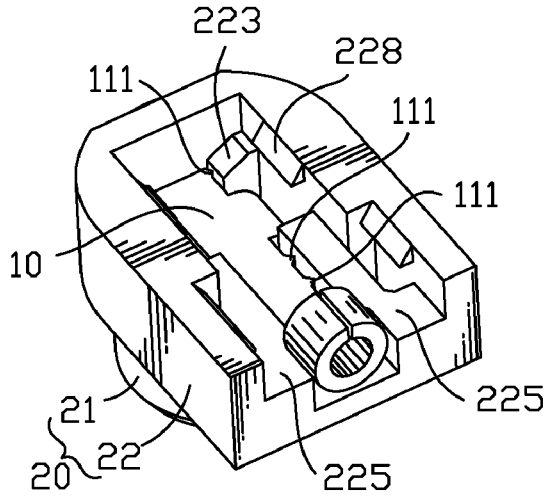
FIG. 4 is an assembly view of the terminal and a housing of the coaxial cable connector.
Figure 5:
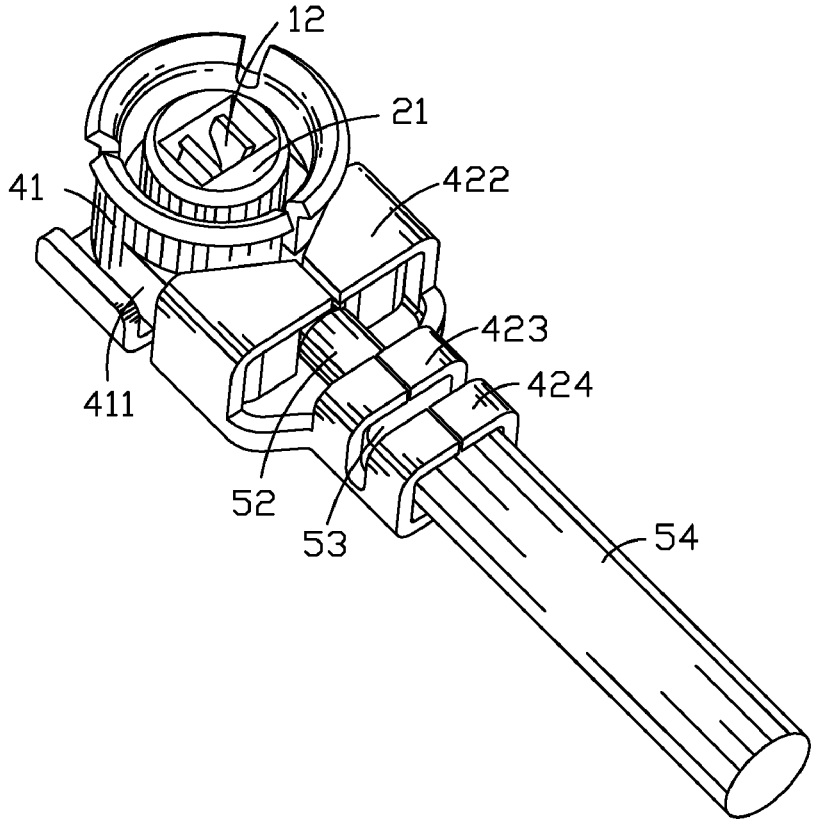
FIG. 5 is a perspective view showing the coaxial cable connector mating with the coaxial cable.

Referring to FIG. 1 and FIG. 3, the cover 30 has a first cover portion 31 and a second cover portion 32 connected to one end of the first cover portion 31. The cover 30 protrudes outward at a bottom portion thereof to form two first wedge portions 311 at opposite sides of the first cover portion 31 and two second wedge portions 321 at opposite sides of the second cover portion 32. A bottom surface of the cover 30 defines a first cambered fillister 33 adjacent to a tip end of the cover 30 and a second cambered fillister 34 smaller than the first cambered fillister 33 between the first cambered fillister 33 and a block 35 which protrudes downward at the bottom surface of the cover 30 and is adjacent to the other tip end of the cover 30. The first cambered fillister 33, the second cambered fillister 34 and the block 35 are of stair-shape therebetween.

Please refer to FIG. 1 to FIG. 5. That the coaxial cable connector assembled with the coaxial cable 5 is described as follows.

Firstly, the inner conductor 51 of the coaxial cable 5 is placed on the base portion 11 the terminal 10 and then the retaining portion 13 is curled up by machine to form a cylindrical construction that retains the inner conductor 51, thus makes the inner conductor 51 electrically contact the terminal 10 stably.

Secondly, the terminal 10 with the coaxial cable 5 assembled thereto is inserted into the housing 20 with the mating portion 12 received in the passageway 227 and the base portion 11 received in both the locating cavity 224 and the receiving recess 226. In this case, the two protruding thorns 111 located at opposite sides of one tip end of the base portion 11 rub against opposite inner surfaces of the locating cavity 224, the several protruding thorns 111 located between the mating portion 12 and the retaining portion 13 rub against opposite inner surfaces of the receiving recess 226.

Then, the cover 30 is mounted on the insulating housing 20 to press the terminal 10 in the housing 20. The first wedge portions 311 and the second wedge portions 321 engage with the wedge lumps 228 of the housing 20. The first cambered fillister 33 of the cover 30 surrounds the retaining portion 13 of the terminal 10. The second cambered fillister 34 surrounds the inner conductor 51 of the coaxial cable 5 and the block 35 press on a top surface of the base portion 11 of the terminal 10.

Finally, the housing 20 is inserted into the trunk portion 41 of the shell 40 with the inner insulator 52 of the coaxial cable 5 passing through the gap 412. Then the fastener portion 42 of the shell 40 is bent toward the trunk portion 41 until the cover portion 421 of the fastener portion 42 completely abuts against the cover 30. Next, the first engagement tongue portions 422, the second engagement tongue portions 423 and the third engagement tongue portions 424 are crimped to retain the arms 411 of the trunk portion 41, the braiding layer 53 and the outer insulator 54 of the coaxial cable 5 respectively. Therefore, the coaxial cable 5 is securely connected with the coaxial cable connector.

Figure 6:
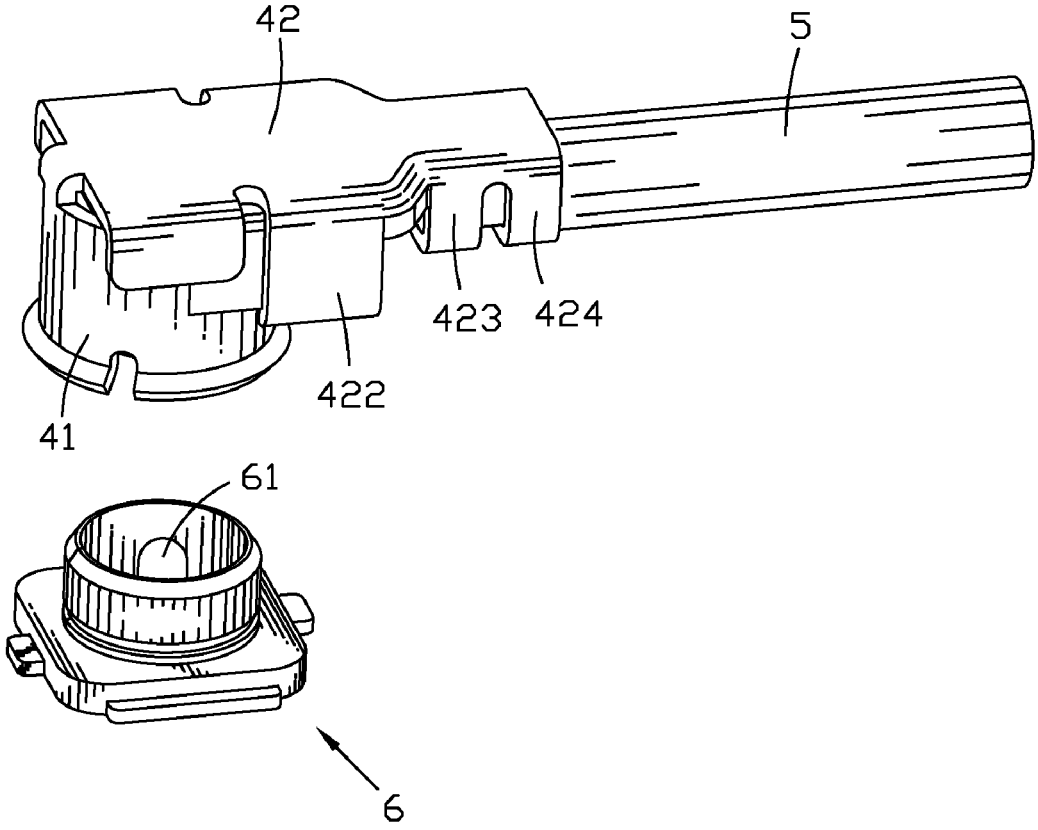
FIG. 6 is a perspective view of a complementary connector matching with the coaxial cable connector.

Referring to FIG. 6, when the coaxial cable connector mates with the complementary connector 6, a central conductor portion 61 of the complementary connector 6 is connected with the mating portions 12 of the terminal 10. Because the terminal 10 is held in the housing 20 firmly, the complementary connector 6 mates with the coaxial cable connector easily and stably.

As described above, the protruding thorns 111 project from the opposite sides of the base portion 11 of the terminal 10 for rubbing against the opposite inner surfaces of the locating cavity 224 and the receiving recess 226, which makes the terminal 10 to be held within the housing 20 securely, so that the movement of the terminal 10 can be avoided. Therefore, the coaxial cable connector mates with the complementary connector 6 stably and signals can be transmitted reliably therebetween.

What is claimed is:

1. A coaxial cable connector, comprising:

a housing having a holding portion defining a bottom board and a tubular portion extending downward from the bottom board, an erect portion protruding upward at a rear portion of the bottom board and defining a locating cavity thereon, two supporting portions protruding upward at a front portion of the bottom board, a receiving recess being defined between the two supporting portions, a passageway being defined between the erect portion and the two supporting portions and penetrating through the bottom board and the tubular portion;

a terminal having a base portion located in both the receiving recess and the locating cavity of the housing, and a mating portion received in the passageway, the base portion defining a plurality of protruding thorns on opposite sides thereof, the protruding thorns rubbing against opposite inner surfaces of the receiving recess and the locating cavity for fixing the terminal in the housing; and a cover received in the housing and pressed on the two supporting portions and the base portion of the terminal, wherein the cover defines a cambered fillister at one end of a bottom surface thereof, the terminal has a retaining portion capable of being curled up to retain a coaxial cable at a tip end of the base portion of the terminal, the cambered fillister surrounds the retaining portion.

2. The coaxial cable connector as claimed in claim 1, wherein the holding portion has two sidewalls attached to the two supporting portions at two opposite sides of the bottom board, and a rear wall behind the erect portion connects with the two sidewalls, the two sidewalls and the rear wall receive the erect portion and the two supporting portions therebetween, the cover is located between the two sidewalls of the holding portion.

3. The coaxial cable connector as claimed in claim 2, wherein the housing defines wedge lumps at an upper portion of each sidewall, the cover has wedge portions respectively positioned at two opposite sides of a bottom portion thereof, the wedge portions correspondingly engage with the wedge lumps.

4. The coaxial cable connector as claimed in claim 1, wherein the cover defines a block protruding downward from a bottom surface thereof, the block is disposed on a top surface of the base portion of the terminal.

5. A coaxial cable connector, comprising:

a housing having a holding portion and a tubular portion extending downward from the holding portion, the holding portion having a bottom board, two sidewalls extended upwardly from two opposite sides of the bottom board, and a rear wall extended upwardly from a rear of the bottom board and connected with the two sidewalls, an erect portion attached to a lower portion of the rear wall and defining a locating cavity in a middle of a top thereof, two supporting portions being attached to lower portions of the two sidewalls, respectively, with a receiving recess formed therebetween, a passageway penetrating through the bottom board and the tubular portion and separating the erect portion and the supporting portions apart from each other;

a terminal having a base portion located in both the receiving recess and the locating cavity of the housing, and a mating portion extended downward from the base portion and received in the passageway, the base portion defining a plurality of protruding thorns on opposite sides thereof for rubbing against opposite inner surfaces of the receiving recess and the locating cavity; and a cover received in the holding portion and surrounded by the rear wall and the two opposite sidewalls for pressing against the terminal, wherein the housing defines wedge lumps at an upper portion of each sidewall above the two supporting portions, the cover has wedge portions respectively positioned at two opposite sides of a bottom portion thereof for correspondingly engaging with the wedge lumps.

6. The coaxial cable connector as claimed in claim 5, wherein the cover defines a block protruding downward from a bottom surface thereof for pressing on a top surface of the base portion of the terminal.

7. The coaxial cable connector as claimed in claim 5, wherein the terminal has a retaining portion capable of being curled up to retain a coaxial cable at a tip end of the base portion, the cover defines a cambered fillister at one end of a bottom surface thereof for surrounding the retaining portion.

* * * * *